United States Patent [19]

Wholahan

[11] 4,080,861

[45] Mar. 28, 1978

[54] CHORUS CONTROL FOR ELECTRONIC MUSICAL INSTRUMENT

[75] Inventor: John Douglas Wholahan, Chicago, Ill.

[73] Assignee: Thomas International Corporation, Chicago, Ill.

[21] Appl. No.: 703,753

[22] Filed: Jul. 9, 1976

[51] Int. Cl.[2] ..... G10H 1/04; G10H 5/02

[52] U.S. Cl. ..... 84/1.24; 84/1.25; 84/DIG. 1; 84/DIG. 4; 84/DIG. 9; 84/DIG. 10; 179/1 F; 333/29

[58] Field of Search ..... 84/1.24, 1.25, DIG. 1, 84/DIG. 4, DIG. 9, DIG. 10, DIG. 26, DIG. 27; 179/1 D, 1 F, 1 G, 1 J, 1 M; 332/16 T, 22; 333/29

[56] References Cited

U.S. PATENT DOCUMENTS

| | | | |
|---|---|---|---|
| 3,749,837 | 7/1973 | Doughty | 179/1 J |
| 3,833,752 | 9/1974 | Van Der Kooij | 84/1.24 |
| 3,866,505 | 2/1975 | Adachi | 84/1.24 |
| 3,881,057 | 4/1975 | Adachi et al. | 179/1 J |
| 3,920,905 | 11/1975 | Sharp | 179/1 J |
| 4,000,676 | 1/1977 | Love | 84/1.25 |

*Primary Examiner*—Stanley J. Witkowski
*Attorney, Agent, or Firm*—James S. Nettleton

[57] ABSTRACT

In an electronic musical instrument, in particular an electronic organ, comprising a circuit for electrically modifying a musical tone by frequency modulation to provide an ensemble effect. The circuit comprises three series connected shift registers which operate as delay circuits and which are driven by three high-frequency oscillators. The oscillators are driven by three vibrato signals. The vibrato signals are out of phase with each other so that each of the clocks is driven by a differently phased signal. The outputs of the shift registers are filtered and are then recombined either electrically or acoustically or both so that a chorus effect is produced. Additionally, the output of the last shift register in the series combination may be fed back to the input of the first shift register in the series combination to introduce additional phase delay in the audio signal for richer ensemble effects.

4 Claims, 4 Drawing Figures

CHORUS CONTROL FOR ELECTRONIC MUSICAL INSTRUMENT

BACKGROUND OF THE INVENTION

1. Field of the Invention

This invention relates to electronic musical instruments and more particularly to circuits which produce chorus or ensemble effects therein.

2. Description of the Prior Art

Chorus or ensemble tonal effects have long been recognized as very desirable in the production of music. The reason for this is that a chorus effect adds a richness, warmth and depth to music.

The effect is created by generating, in unison, a number of similar tone signals which are slightly out of tune or phase relationship.

Thus, in the production of music by an orchestra, the effect is generated naturally by numbers of similar instruments, such as violins for example, playing in unison. Since many musicians are unable to play exactly in tune, the chorus effect is created without any special effort or instrumentation.

Many circuits have been devised for generating a chorus effect in electronic musical instruments. The majority of these use vibrato effects applied to a number of equally pitched tone signals. The modulated tone signals are then sounded simultaneously. The resulting sound has an ensemble characteristic which is similar to a true chorus effect. By increasing the vibrato vibrations, more realistic chorus effects can be generated.

U.S. Pat. No. 2,905,040 shows an apparatus for producing a chorus effect wherein two audio frequency oscillators at equal nominal musical pitches are driven by two out of phase vibrato signals. The resulting vibrato modulated audio signals are then recombined electrically to produce a chorus effect. In addition, this patent discloses an electro-mechanical apparatus for producing a chorus effect wherein a delay line is continuously scanned by means of two commutators which are driven in synchronism, but 180° out of phase, at a vibrato rate. The delay line is driven by a source of electrical musical tone signals. The resultant vibrato modulated tone signals are then reproduced and recombined acoustically.

U.S. Pat. No. 3,083,606 shows two vibrato units which are driven by out of phase control voltages and which modulate the tone signals emanating from a single tone signal source. The outputs of the vibrato units are amplified and reproduced acoustically to produce an ensemble effect.

U.S. Pat. No. 3,749,837 shows a circuit for producing an ensemble effect wherein shift registers are used to frequency modulate the audio signal.

U.S. Pat. No. 3,833,752 shows a system wherein three parallel shift registers are used and which are driven by out of phase vibrato oscillators to generate an ensemble effect.

U.S. Pat. No. 3,866,505 shows a system which is substantially equivalent to that of U.S. Pat. No. 3,833,752.

SUMMARY OF THE INVENTION

I have discovered that if a series combination of delay circuits is used, additional complexity is introduced to the vibrato modulated tone signals, which creates a more realistic chorus effect.

The chorus control circuit, according to the preferred embodiment of the invention, includes a series combination of several delay circuits which each operate to introduce delay to the incoming audio signal. The delay circuits are modulated by complex vibrato signals which are similar but which operate at different phases. The output of the last delay circuit in the series combination may be fed back to the input of the first delay circuit in the series combination, thus introducing additional complexity in the tone signals. The outputs from the delay circuits can be recombined electrically or acoustically to reproduce the chorus effect.

The delay circuits in the preferred embodiment are analog shift registers, although other forms of delay circuits may be used.

It is therefore an object of the present invention to produce a highly desirable chorus effect with a minimum of components.

A further object of the invention is to produce a chorus effect of greater depth and warmth than the prior art circuits.

DESCRIPTION OF THE PREFERRED EMBODIMENTS

Figure 1:
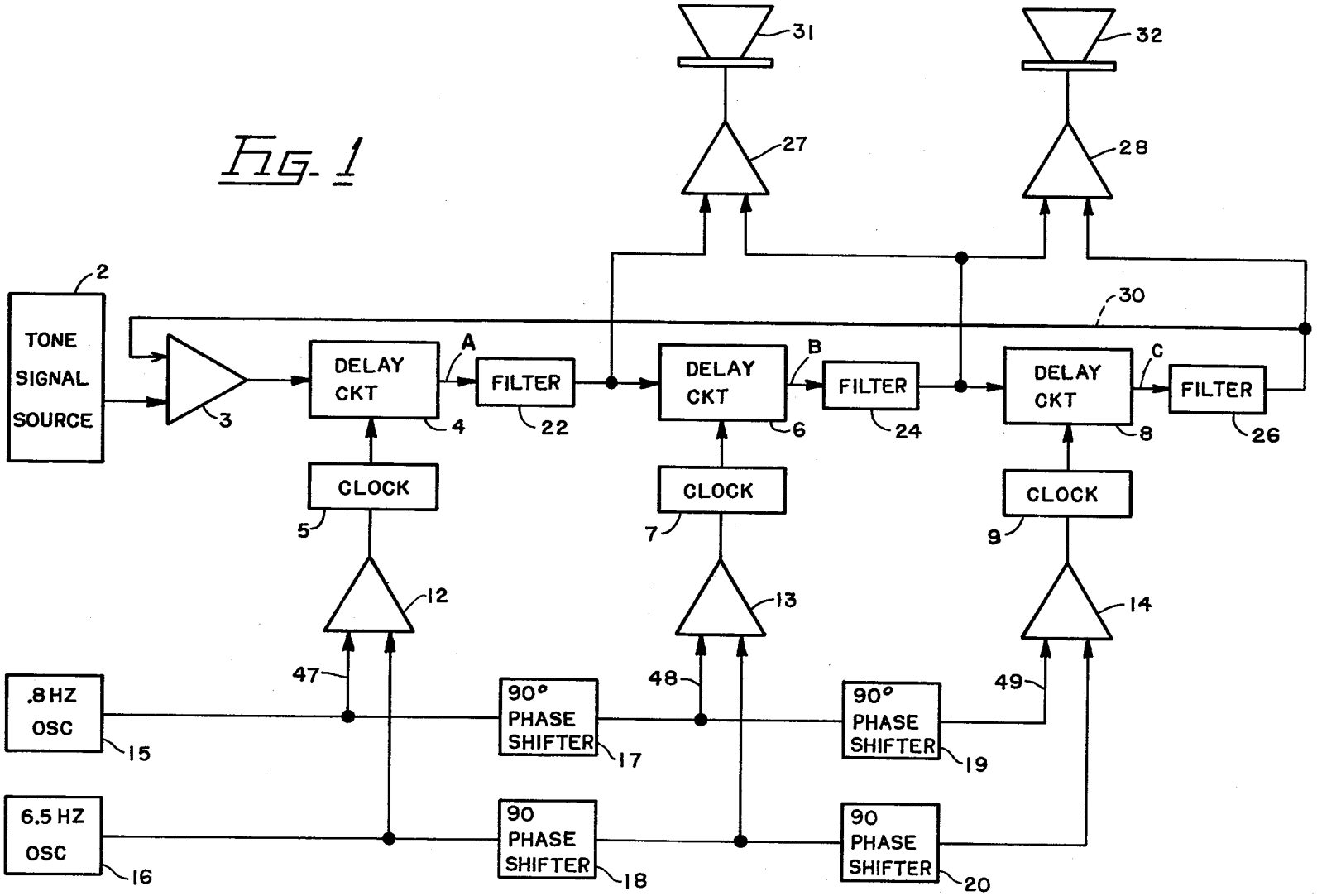
FIG. 1 is a schematic block diagram of a chorus control constructed in accordance with the present invention.

The electrical musical instrument, which may be an electronic organ, contains a source of tone signals and keys or similar actuation devices for calling forth the tones. This is schematically represented in FIG. 1 by the block denoted by number 2. The tone signals are amplified in summing amplifier 3 and are then fed to a delay circuit here indicated by numeral 4. Two additional delay circuits 6 and 8 are connected in series combination with the delay circuit 4. These delay circuits 4, 6 and 8 may comprise commercially available shift registers such as those described by F. L. J. Sangster and K. Teer in an article entitled "Bucket Brigade Electronics — New Possibilities for Delay Time Axis Conversion and Scanning" IEEE, Journal of Solid State Circuits, Vol. SC-4, No. 3, June 1969. The delay circuits are driven by three clocks 5, 7 and 9.

Two vibrato oscillators 15 and 16 are shown. These oscillators generate sine wave shaped oscillations. The outputs of the oscillators are added in summing amplifiers 12, 13 and 14. Before summation in summer 13, both oscillator signals are phase shifted 90° in phase shifters 17 and 18 respectively. Before addition in summer 14, both oscillator signals are phase shifted 180° in phase shifters 17, 19 and 18, 20 respectively. Prior to summation, the oscillator signals are scaled appropriately so that the outputs of the summing amplifiers appear as a sine wave with a higher frequency low amplitude sine wave superimposed thereon. In the preferred embodiment, the low frequency oscillator operates at 0.8 Hz and the high frequency oscillator operates at 6.5 Hz. Preferably the oscillator signals should be in the 0–1 Hz and 5–7 Hz ranges respectively.

Alternatively, a single oscillator could be used. However, by using two oscillators, more complex variations are introduced into the tone signals which results in a chorus effect combined with a vibrato effect. By using a single low frequency oscillator, only a chorus effect will be produced. By using a single high-frequency oscillator, only a vibrato effect will be produced.

For an optimum chorus effect, the amount of phase shift introduced by the phase shifters for a three stage circuit, should be anywhere from 60° to 120° . However, it has been found that small phase shifts cause the total output effect to appear like a large vibrato effect rather than a chorus effect. The reason for this is that the phase delays will be additive. If the phase delays are too large, a reverberation effect will be generated, because some of the phase delays will cancel each other. The most desirable amount of phase shift is best determined empirically and may actually vary from listener to listener.

The outputs from the summing amplifiers 12, 13 and 14 are used to control the frequencies of three clocks 5, 7 and 9. The output frequencies of these clocks vary in proportion to the amplitude of the output signals of summers 12, 13 and 14. The clock output pulses, in turn, control the shift rates of shift registers 4, 6 and 8. The shift rate determines the delay introduced by the shift registers. Since the amplitudes of the output signals of summers 12, 13 and 14 vary continually, the delays introduced into the tone signals will vary continually.

The outputs of the delay circuits are connected to the inputs of electronic filters 22, 24 and 26. The filters are used to filter out the clock frequencies which have been introduced by the delay circuits. Since the delay circuits in the preferred embodiment comprise shift registers, the outputs which are generated on lines A, B and C will be chopped signals at the frequencies of the clocks. The clock frequencies are preferably on the order of 30–90 KHz. These frequencies could introduce distortion in the output sound and for that reason must be filtered out.

The outputs from the filters could be connected directly to output speakers. In the preferred embodiment shown, three speakers would therefore be used. The phase shifted vibrato modulated tone signals would then be sounded and combined acoustically to generate a chorus effect. Because the speakers would be physically spaced apart, the listener would in effect hear a stereo-like effect which produces a very realistic and pleasing chorus or ensemble effect. However, in the preferred embodiment shown, only two speakers are used. The outputs from the filters are combined electrically in summers 27 and 28 prior to routing them to the speakers 31 and 32 respectively. Alternatively, only a single speaker could be used in which case the electrical tone signals would be combined electrically in a single summing amplifier. The resulting chorus effect is not as pleasing as that achieved with multiple speakers due to the absence of the above-mentioned stereo effect.

An additional input for summing amplifier 3 is shown. Line 30 connects the output of the last delay stage to the input of the summing amplifier. This causes the resulting chorus effect to be more pleasing as the resulting tone signal modulation is more complex.

Figure 2:
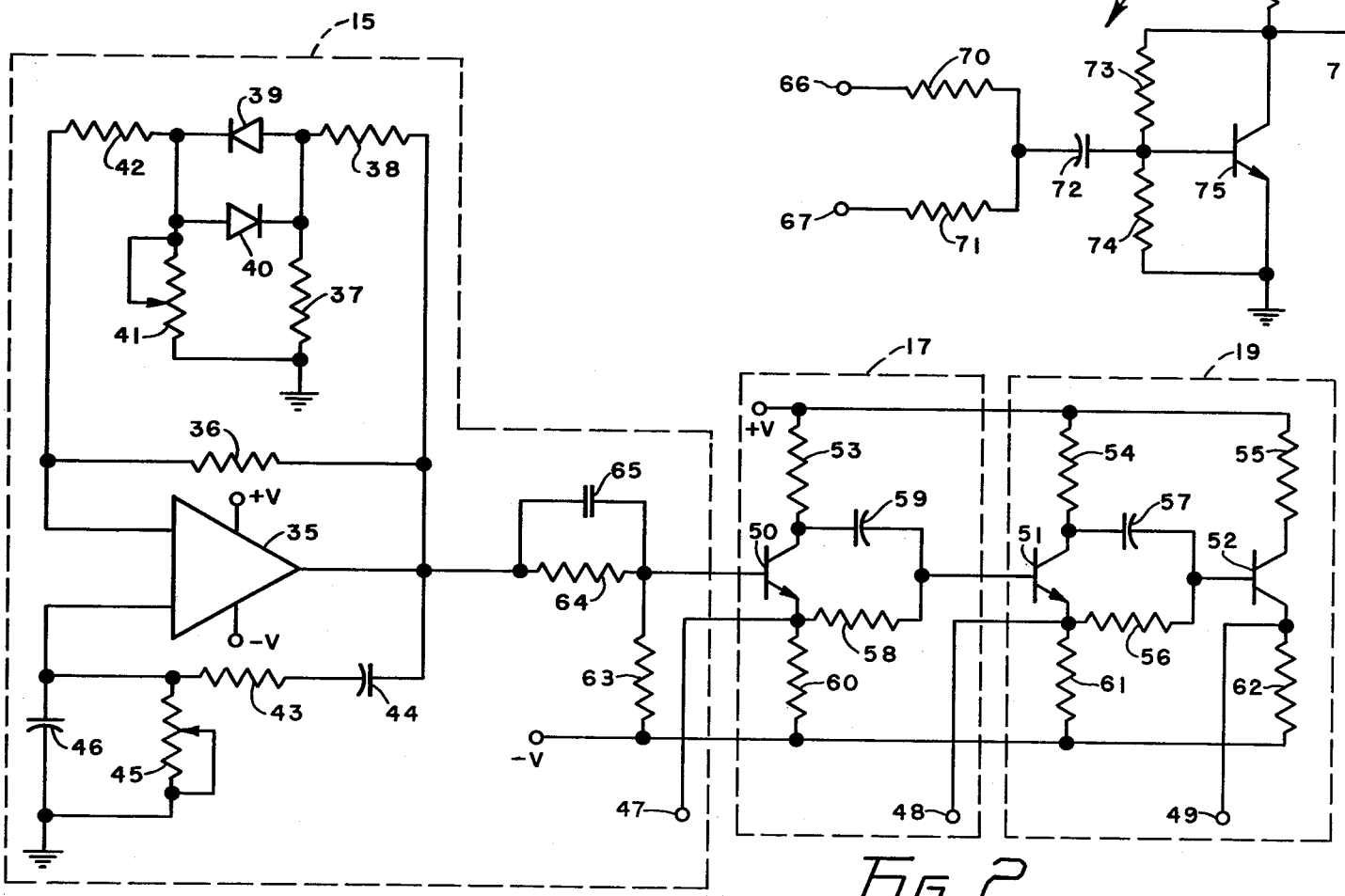
FIG. 2 is a schematic arrangement of a circuit portion including a vibrato oscillator and a phase shifter therefor.

Turning now to FIG. 2, one of the vibrato oscillators and a phase shifter are shown. The oscillators comprise identical circuits except for circuit component values. The vibrato oscillator comprises a Wien bridge oscillator employing an integrated circuit operational amplifier 35. The frequency of the oscillator is determined by resistor 43, potentiometer 45 and capacitors 44 and 46. Diodes 39 and 40, resistors 37, 38 and 42, and potentiometer 41 are used for stabilization and to reduce distortion. The output signal of the oscillator is a sine wave and this is connected to the input of the phase shifter.

Phase shifting is effected by means of an active element, in this case a transistor, 50 and a capacitor 59 resistor 58 combination which is connected to the collector and emitter of the transistor. Since the collector and emitter signals are 180° out of phase, proper proportioning of components 58 and 59 can achieve any desired phase shift between 0° and 180° at the junction point of components 58 and 59. The phase shifter circuit contains two stages. The output terminal 47 will have a signal which is in phase with the input from the oscillator. The output terminal 48 carries an oscillator signal which has been shifted in phase by components 50, 58 and 59. Output terminal 49 carries an oscillator signal which has been further shifted in phase by transistor 51, resistor 56 and capacitor 57.

In general, the phase shift per stage should not be greater than 360/N where N is the number of delay circuits. In the preferred embodiment, the phase shift per stage has been selected as 90° .

Oscillator 16 and phase shifters 18 and 20 comprise circuitry identical to the circuits 15, 17 and 19 shown in FIG. 2, except for component values.

Figure 4:
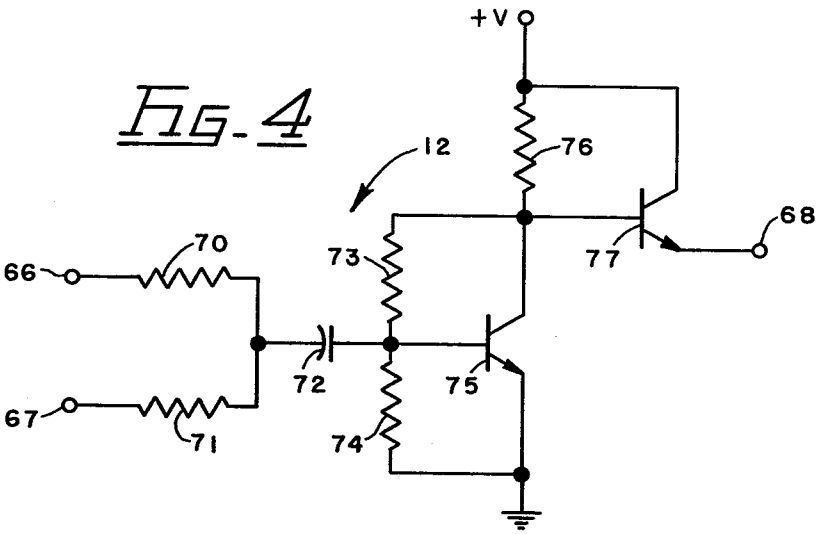
FIG. 4 is a schematic representation of a summer for two vibrato signals.

FIG. 4 shows the summer amplifier 12 which combines two vibrato signals. The vibrato signal from oscillator 15 at terminal 47 is connected to terminal 66. A corresponding vibrato signal from oscillator 16 is connected to terminal 67.

Resistors 70 and 71 scale the oscillator signals so that the resultant output signal on output terminal 68 comprises a low frequency sine wave with a small amplitude high-frequency sine wave superimposed thereon.

Transistors 75 and 77 amplify the vibrato oscillator signal in well-known manner.

Figure 3:
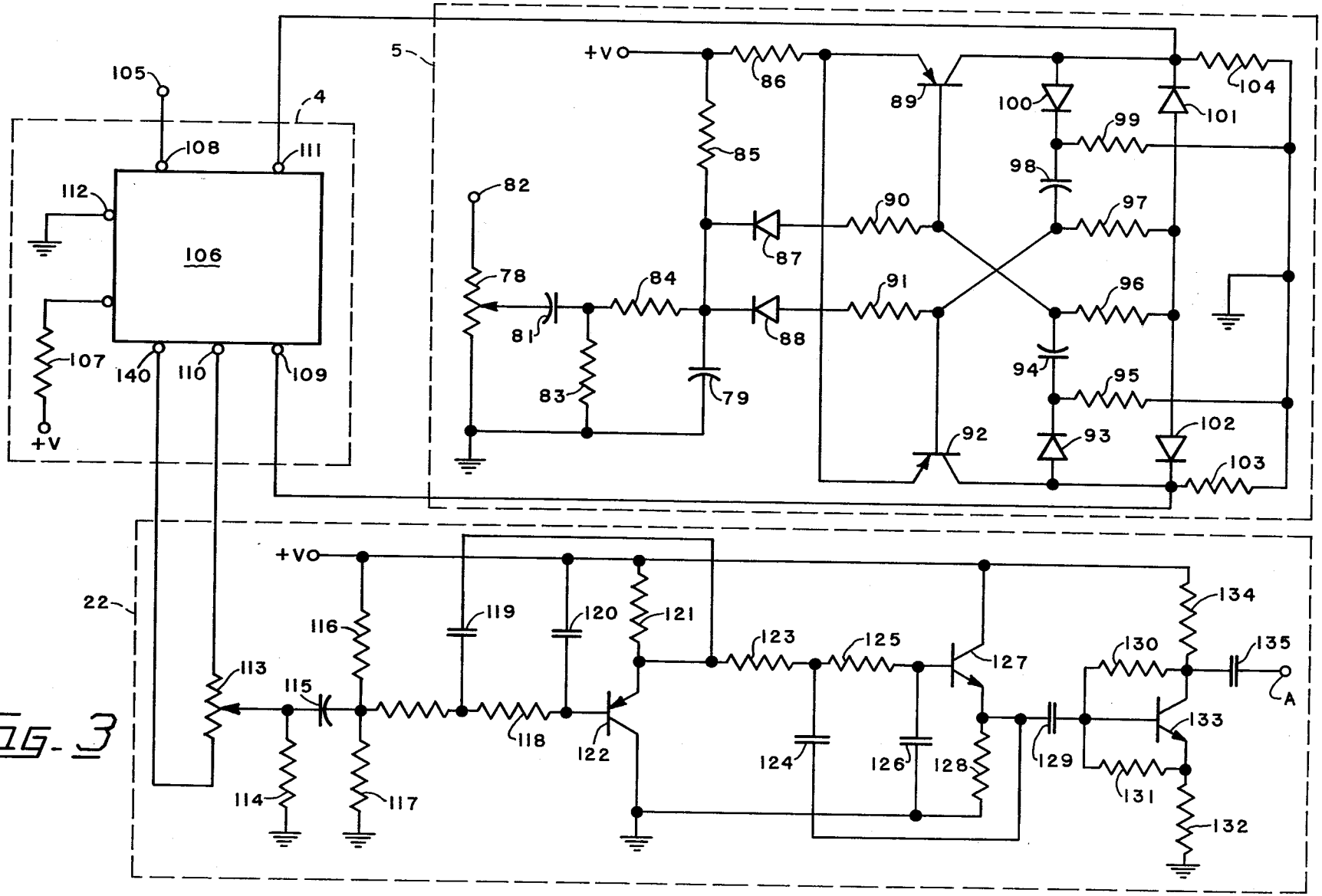
FIG. 3 is a schematic representation of a clock, a delay circuit, a filter and an amplifier.

Turning now to FIG. 3, to vibrato output signal on terminal 68 is fed to input terminal 82 of clock circuit 5. Potentiometer 78 scales the input signal. Since the magnitude of the vibrato signal determines the clock frequency, potentiometer 78 controls the frequency range of the clock.

The clock comprises a bistable multivibrator of the well-known type including transistors 89 and 92 whose bases and collectors are cross coupled. Resistor 97 and capacitor 98 determine the frequency of one side of the multivibrator and capacitor 94 and resistor 96 determine the frequency of the other side. Diodes 93 and 100 and resistors 95 and 99 square up the wave form. Capacitor 79 and resistor 84 filter out noise in the input signal from the terminal 82. Capacitor 81 is used for DC isolation. Potentiometer 78 controls the input signal amplitude and therefore controls the frequency range of the multivibrator.

Diodes 87 and 88 and resistors 90 and 91 function as a drain on the bases of transistors 89 and 92 and therefore, in combination with the amplitude of the input signal, determine the input frequency of the multivibrator.

As the amplitude of the input signal changes, the base voltage level at which the transistors can switch will change as well. The pulse length of the multivibrator output pulses is therefore determined by the magnitude of the input voltage.

The delay circuit 106 is a commercially available shift register such as, for instance, Matsushita part number MN-3002. The audio signal is fed in from input terminal 105 to input terminal 108. The clock signal is fed in on terminals 109 and 111. The delay circuit has the ability, each time a clock pulse appears, to sample the amplitude of the audio signal and to store the sample. When the next clock pulse comes along, this sample is shifted to the next shift register stage in well-known manner. The output of the shift register delay circuit on terminal 110 consists of a sequence of samples which are delayed in accordance with the clock signals.

This sequence of samples is fed to filter circuit 22. The output from the delay circuit also appears on terminal 140. The clock pulses of the signal on terminal 140 are 180° out of phase with the clock pulses of the signal on terminal 110. These two out of phase signals are connected to opposite ends of the potentiometer 113 which recombines them and therefore cancels the clock pulses. Potentiometer 113 is set for maximum clock pulse cancellation. However, not the entire clock pulses can be cancelled and therefore filter 22 is employed for further clock pulse attentuation. Filter 22 is a four pole Butterworth active filter. Capacitor 119 provides high-frequency negative feedback to reduce high-frequency gain. Additional feedback is provided by capacitor 124. Feedback, by means of resistors 130 and 131, is used with transistor 133 to provide stability. The output of the filter appears on terminal A and is a frequency modulated tone signal whose pitch varies in accordance with the amplitude of the vibrato signal on terminal 82.

Delay circuits 6 and 8, clock circuits 7 and 9 and filter circuits 24 and 26 are similar to the circuitry described for delay circuit 4, clock 5 and filter 22 of FIG. 3.

Although I have described my invention with reference to a particular illustrative embodiment, many changes and modifications of the invention may become apparent to those skilled in the art without departing from the spirit and scope of the invention. I therefore intend to include within the Patent all such changes and modifications as may reasonably and properly be included within the scope of my contribution to the art.

Having described the invention, the embodiments of the invention in which an exclusive property or privilege is claimed are defined as follows:

1. In an electronic musical instrument, the combination of:

a source of tone signals;

a plurality of delay circuits connected in series circuit combination and having the source of tone signals connected to the input of said combination;

circuit means for modulating each of said delay circuits with a cyclical signal at a vibrato rate;

feedback means for feeding back the output of said last series connected delay circuit to the input of the first series connected delay circuit;

means connected to the outputs of said delay circuits for electronically mixing the output signals of said delay circuits; and sound reproducing means connected to said mixing means whereby the reproduced tone signals generate a chorus effect.

2. In an electronic musical instrument, the combination of:

a source of tone signals;

a plurality of delay circuits connected in series circuit combination and having the source of tone signals connected to the input of said combination;

circuit means for modulating each of said delay circuits with a cyclical signal at a vibrato rate;

feedback means for feeding back the output of said last series connected delay circuit to the input of the first series connected delay circuit;

sound reproducing means connected to the outputs of said delay circuits; and a plurality of electronic filters respectively associated with said plurality of delay circuits, each of said filters having its input connected to the output of its associated delay circuit and its output connected to said sound reproducing means, whereby the reproduced tone signals generate a chorus effect.

3. An electronic musical instrument comprising an audio frequency generating source;

a first delay circuit means connected to said source, said first delay circuit means being modulated by a first vibrato oscillator;

a second delay circuit means connected in series with said first delay circuit means, said second delay circuit means being modulated by a second vibrato oscillator which is out of phase with said first oscillator;

a third delay circuit means connected in series with said second delay circuit means, said third delay circuit means being modulated by a third vibrato oscillator which is out of phase with said first two oscillators;

a plurality of electrical filters, each of which is respectively connected to the output of one of the plurality of delay circuit means;

a plurality of speakers connected to said filters, whereby the delayed audio signals produced by the delay circuit means are combined acoustically to produce a chorus effect.

4. The electronic musical instrument of claim 3 wherein said first and said second vibrato oscillators are 90° out of phase and wherein said first and said third vibrato oscillators are 180° out of phase.

* * * * *